US011390452B2

(12) United States Patent
Shalowitz

(10) Patent No.: US 11,390,452 B2
(45) **Date of Patent: *Jul. 19, 2022**

(54) FOOD CONTAINER AND DISPENSER

(71) Applicant: Joel Shalowitz, Baltimore, MD (US)

(72) Inventor: Joel Shalowitz, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/085,114

(22) Filed: Oct. 30, 2020

(65) Prior Publication Data

US 2021/0047103 A1 Feb. 18, 2021

Related U.S. Application Data

(63) Continuation-in-part of application No. 16/990,251, filed on Aug. 11, 2020, now Pat. No. 11,261,019, which is a continuation of application No. 16/395,523, filed on Apr. 26, 2019, now Pat. No. 10,737,871.

(60) Provisional application No. 62/927,916, filed on Oct. 30, 2019, provisional application No. 62/663,336, filed on Apr. 27, 2018.

(51) Int. Cl.
*B65D 83/00* (2006.01)

(52) U.S. Cl.
CPC ..... *B65D 83/0072* (2013.01)

(58) Field of Classification Search
CPC ..... B65D 83/0005; B65D 83/0072; B65D 35/14; B65D 35/24; B65D 35/28; B65D 25/04; B65D 81/3211; B65D 81/3255; B65D 83/00; B65D 83/0022; B65D 83/0033; B65D 83/005; B65D 83/0055; B65D 83/0061; B65D 83/0066; B65D 83/0077; B65D 83/0083; A47G 19/32; A47G 19/34; A47F 1/02; A47F 1/03; A47F 1/04; A47F 1/06; A45D 34/043; A45D 2200/055; B65B 3/04; B65H 1/08; B05C 17/00576

See application file for complete search history.

(56) References Cited

U.S. PATENT DOCUMENTS

2005/0211732 A1* 9/2005 Cable ..... B65D 83/0005 222/327
2006/0201963 A1* 9/2006 Sines ..... B65D 83/0005 221/279
2006/0249534 A1* 11/2006 Sainz ..... B65D 83/04 222/92
2008/0156831 A1* 7/2008 Nakayama ..... B32B 1/02 222/327

(Continued)

*Primary Examiner* — Ericson M Lachica
(74) *Attorney, Agent, or Firm* — Whiteford, Taylor & Preston, LLP; Gregory M. Stone

(57) ABSTRACT

A portable food carrier is disclosed, including a flexible, compressible outer container body and an internal lift having a tapered bottom. The tapered bottom of the lift is particularly configured to allow a user to grasp the carrier and squeeze the container body at the location of the taper, causing the lift to move upward in the container, in turn pushing food product located above the lift toward an open, top mouth of the container, where the user may then access and eat the food product. The lift is configured to interact with the interior of the container in such a way so as to assist the user in maintaining smooth movement as the user squeezes the outside of the container, thus making it optimized for use with only one hand.

23 Claims, 13 Drawing Sheets

(56) References Cited

U.S. PATENT DOCUMENTS

2008/0302826 A1* 12/2008 Rich, Jr. ..... G01F 11/025
222/158
2009/0294484 A1* 12/2009 Avairis ..... B65D 83/0011
222/390
2013/0313258 A1* 11/2013 Sines ..... B65D 81/22
220/288
2015/0375905 A1* 12/2015 Caunant ..... B65B 43/08
53/456

* cited by examiner

FOOD CONTAINER AND DISPENSER

CROSS-REFERENCE TO RELATED APPLICATIONS

This application claims the benefit of U.S. Provisional Patent Application No. 62/927,916 titled "Food Container and Dispenser," filed Oct. 30, 2019 by the inventor herein. This application is also a continuation-in-part of U.S. patent application Ser. No. 16/990,251 titled "Food Container and Dispenser," filed Aug. 11, 2020 by the inventor herein, which application is a continuation of U.S. patent application Ser. No. 16/395,523 titled "Food Container and Dispenser," filed Apr. 26, 2019 by the inventor herein and now issued as U.S. Pat. No. 10,737,871, which application claims the benefit of U.S. Provisional Patent Application No. 62/663,336 titled "Portable Food Container and Dispenser," filed Apr. 27, 2018 by the inventor herein. The specifications of each of the foregoing are incorporated herein by reference in their entireties.

FIELD OF THE INVENTION

This invention relates to food dispensers and packaging, and more particularly to hand-held food dispensers that are manually operable for ease of operation by a user.

BACKGROUND

A confluence of current trends and behaviors continue to propel food consumers to desire containers that further facilitate accessibility to easy eating as they navigate the demands of their busy lives, dietary considerations, and the daily constraints they find while negotiating all of the when and where's of eating. These constraints range from the assistive technology needs of disabled consumers that have physical limitations, to the wide variety of on- and off-premise settings and occasions in which general consumers find themselves constrained in terms of convenience, speed, ease of use, and portability. Sadly, in many occasions, consumers are left with choices such as: contending with limited flat surfaces and trying to keep level unsteady containers on their laps; trying to eat when having to keep their primary attention (and often their eyes) on something else; or the variety of commuting, event, and/walking around moments where there may be limitations of time, space, or even just having more than one hand to hold containers, use utensils, or even eat the food without spilling or wearing it.

The reality is that consumers seek the same measure of control over ingredients and ease of eating during these constrained times. Thus, there remains a need in the art for portable food carriers capable of packaging, for example, a single serving of a variety of snacks or meals in a container designed for ease of use such that the consumer can eat the contents, and preferably that will allow one-handed operation to dispense food so as to maximize convenience in such circumstances as mentioned above.

SUMMARY OF THE INVENTION

Disclosed herein is a food container and dispenser that offers an intuitive tool that helps consumers manage the pace and success of eating, thereby enhancing rather than stressing the eating experience in these occasions. In accordance with certain aspects of an exemplary embodiment, a preferably portable food carrier is provided that includes a flexible, compressible outer container body and an internal lift. Preferably, the lift has a tapered lower wall that is particularly configured to allow a user to grasp the carrier and squeeze the container body at the location of the taper, causing the lift to move upward in the container, in turn pushing food product located above the lift toward an open, top mouth of the container, where the user may then access and eat the food product. The lift is configured to interact with the interior of the container in such a way so as to assist in providing smooth movement as the user squeezes the outside of the container, thus making it optimized for use with only one hand when the user is either on the go or is otherwise constrained.

In a particular embodiment, a flexible layer may be provided that is either affixed to the interior of the flexible, compressible outer container body, or is insertable into the outer container body when the container is intended to be used, which flexible layer may provide a barrier between food contents inside of the flexible layer and the interior wall of the outer container body. The flexible layer may either receive or have the lift positioned inside of the flexible layer (i.e., in direct contact with the food contained within the flexible layer), or alternatively may be used with the lift positioned below the lower, outer portion of the flexible layer (i.e., on the opposite side from the food contained within the flexible layer). In some configurations, the lift may be formed integrally with the flexible layer (i.e., such that the flexible layer and the lift form a single, unitary piece). In such configurations, the lift may comprise a thickened or hardened region of the flexible layer at its bottom, providing sufficient rigidity or resistance against collapsing or deforming so that it may be squeezed and thus moved toward the outlet of the food container and dispenser. In each of the foregoing cases, the lift preferably interacts with the internal layer so as to cause it to gradually invert from the bottom towards the top of the container body as the lift is moved upward in the container body. In certain configurations, such inversion may cause portions of the internal layer to gather between the lift and the interior wall of the outer container body, which may aid the user in consistent movement of the lift towards the dispensing outlet of the container.

In a particular embodiment, the interior flexible layer may be provided, with or without the lift affixed to, inside of, or integral with the interior flexible layer, as a cartridge for removable placement into an outer container, optionally with a connector provided that engages a portion of the interior flexible layer with a portion of the outer container to hold at least a part of the interior flexible layer (e.g., the upper portion adjacent the outlet of the food container and dispenser) fixed with respect to the outer container. Such assembly may allow the flexible layer (and optionally the lift) to be sold as a single, disposable unit. In other configurations, both the outer container and the interior flexible layer may be provided as a cartridge for removable placement into another flexible, hand-held container, with or without the foregoing connector between the interior flexible layer, outer container, and the further flexible hand-held container, such that the interior container, flexible layer, and lift may optionally be sold as a single, disposable unit.

In accordance with certain aspects of an embodiment, a hand-held food dispenser is provided, comprising a first container having one or more manually compressible walls, a lift inside of the first container and engaging an interior of the first container such that manual compression on an outside of the first container causes a portion of the interior of the first container to engage at least a portion of the lift to cause the lift to move along a length of the first container, a flexible, invertible layer inside of the first container having a first portion in contact with the lift, and a second portion extending upward from the lift toward a top end of the first container, and a second container having one or more manually compressible walls, wherein the first container is removably attached inside of the second container.

In accordance with further aspects of an embodiment, a hand-held food dispenser is provided, comprising a container having one or more manually compressible walls, a lift inside of the container and engaging an interior of the container such that manual compression on an outside of the container causes a portion of the interior of the container to engage at least a portion of the lift to cause the lift to move along a length of the container, and a flexible, invertible layer inside of the container having a first portion in contact with the lift, a second portion extending upward from the lift toward a top end of the container, and a third portion connecting the first portion to the second portion, wherein the third portion is positioned between the lift and the one or more manually compressible walls.

In accordance with still further aspects of an embodiment, a hand-held food dispenser is provided, comprising a flexible, invertible food package layer having side walls and a lift receiver at a bottom of the flexible, invertible food package layer, the lift receiver being defined by a first portion of the flexible, invertible food package layer positioned to engage a top edge of a lift positioned in the lift receiver and a folded portion of the flexible, invertible food package layer, and a lift positioned with respect to the lift receiver such that a top edge of the lift is in contact with the first portion of the flexible, invertible food package, and such that side portions of the lift are positioned adjacent the folded portion of the flexible, invertible food package layer.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized. The present invention is illustrated by way of example, and not by way of limitation, in the figures of the accompanying drawings, in which like reference numerals refer to similar elements, and in which:

DETAILED DESCRIPTION OF THE PREFERRED EMBODIMENTS

The invention may be understood by referring to the following description and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Figure 2:
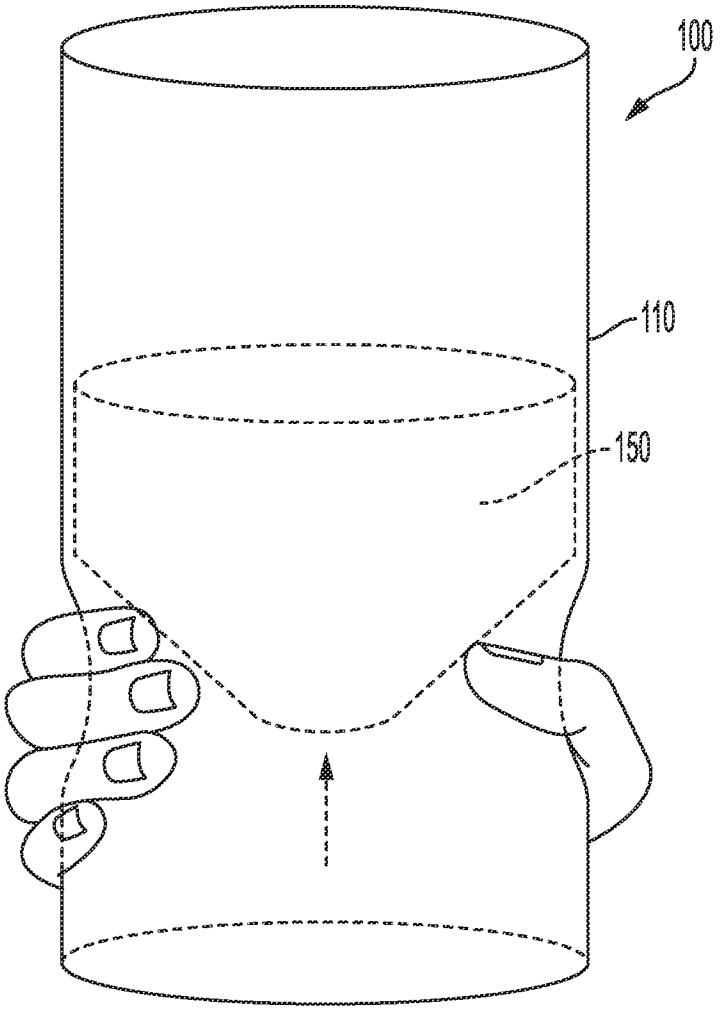
FIG. 2 is a side view of the food container and dispenser of FIG. 1 with the lift shown in a partially raised position.
Figure 1:
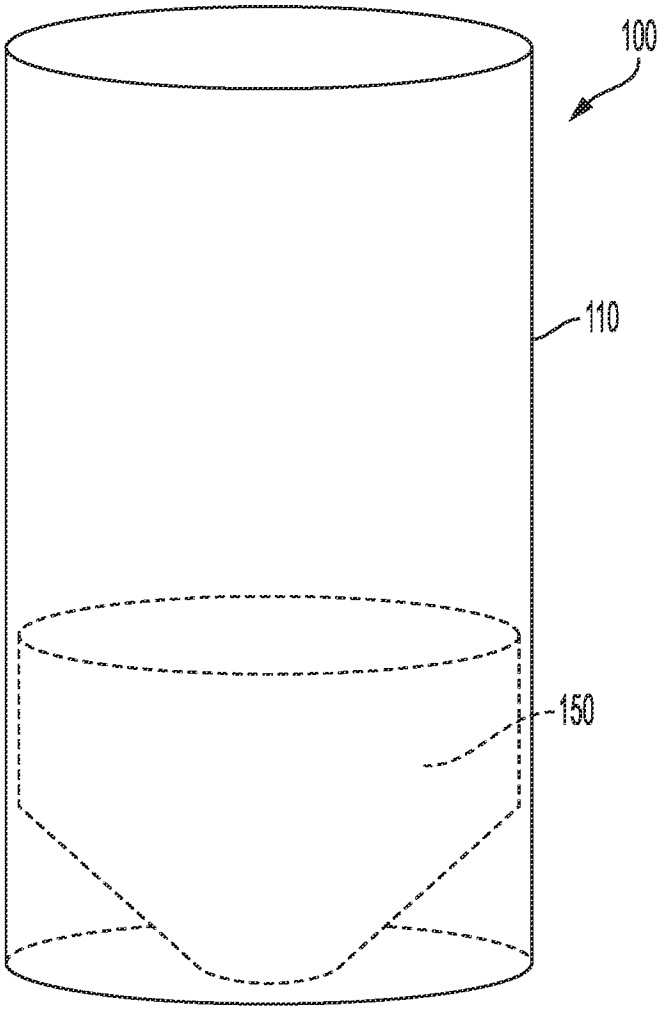
FIG. 1 is a side view of a food container and dispenser in accordance with certain aspects of an embodiment of the invention.

By way of summary, and with reference to FIG. 1, disclosed herein is a food dispensing system 100 that includes a flexible, manually compressible external container body 110 and an internal lift 150 that is moveable inside and along at least a portion of the length of the container body 110. Lift 150 is preferably sufficiently rigid so as to not permanently deform or lose its structural integrity when external container body 110 is manually compressed with sufficient force to move lift 150 within container body 110. In use, the lift 150 is initially positioned at a location within the container so as to define a volume between the top of the lift and the top of the container, which volume is sufficient to preferably and in exemplary embodiments hold a meal or snack sized portion of food, such as for example ½ to 4 cups of food product, that a user wishes to consume using the food dispensing system 100. Of course, other sizes of food portions may likewise be used without departing from the spirit and scope of the invention. For example, lift 150 may be initially positioned at the bottom of the interior of container body 110, with food product loaded into the container body 110 on top of lift 150. With the food product positioned inside of the container body 110 and atop the lift 150, the user may gradually squeeze or pinch the outside of the flexible, manually compressible container body 110, as shown in FIG. 2, at a location below the top surface of the lift 150 so as to cause the lift to move upward in the container body 110. Doing so, in turn, pushes the food product 10 toward the open top of the container body 110 to allow the user to progressively access and consume the food product. Such a configuration allows easy, one-handed operation of the food dispensing system 100, providing the user a comfortable, easy to use, non-messy dispensing tool for consuming food while, for example, on the go or otherwise constrained.

As shown in FIG. 1 and FIG. 2, and in accordance with certain features of an embodiment, the outer-most edge of lift 150, or at least a portion thereof, may be of a dimension that generally matches or conforms to the internal perimeter of container body 110, at least in the region of intended travel of lift 150 within container body 110. In such configurations, this may create a close tolerance between the outer perimeter of lift 150 and the interior of container body 110, which in turn may substantially hinder food product from passing between lift 150 and container body 110 and ending up unused below lift 150. Optionally, lift 150 may be configured having varying diameters, such as a larger diameter at an upper portion of lift 150 that comes into contact with food product in container body 110, and a smaller, lower portion of lift 150 that includes a tapered portion that interacts with the interior surface of the container body 110 when compressed inward to push lift 150 upward through container 110. Optionally, container 110 may have a similar profile of a larger diameter in the upper portion of container 110, and a smaller diameter in the lower portion of container 110. Such a configuration may be useful where, for example, the food product to be used with system 100 is one that would typically be eaten from a bowl, with each squeeze by the user of the outside of container body 110 raising the bottom portion of the bowl (i.e., the top face of lift 150).

An important feature of the invention is the interaction between the lift 150 and the container body 110 that both eases operability, so that a user may easily push food 10 toward the open top of the container body 110 with a one-handed, intuitive pinching motion, preferably assisting the user in maintaining smooth movement of lift 150, and without the lift 150 tilting, rolling, or jumping as it travels along the length of the interior of the container body 110. In certain configurations, the interaction between lift 150 and container body 110 is such so that a holding force also exists (e.g., as a result of friction between the lift 150 and the interior of the container body 110) so that the lift 150 remains at its location when the user stops applying external pressure on the outside of the container body 110, or at least retracts or reverses only a small amount (e.g., preferably not more than, for example, 2.5 cm) from such location when the user stops applying external pressure on the container body 110. Likewise, the interaction between the lift 150 and the container body 110 further allows the lift 150 to reverse direction if the user manually pushes the lift 150 back towards the bottom of the container body 110 (such as by applying external pressure on the outside of the container body 110 at a location above the top surface of the lift 150), which may be desirable to lower the level of food product downward and away from the top mouth of the flexible sleeve when a user wishes to save some of the food product for later consumption.

With such a configuration, a user, by simply squeezing the sides of the exterior of the container body 110 with their one or more hands, can control the lift 150 so that the food product is moved upward toward the open top of the container body 110 and eaten at the desired pace or otherwise controlled and/or positioned down or to an optimal position, for example for rest and/or transport.

While it is envisaged that any edible product may be placed in such a system 100, by way of non-limiting example, exemplary characteristics of such foods that might be carried and dispensed by such system may include those having some moisture and/or that easily come apart and/or are hard to consume with one hand or with limited dexterity, or that are messy because of their consistency, are comprised of numbers of small pieces, or include sauces/juices or toppings or crumbliness, and/or that could otherwise be unwieldy without eating utensils or because of physical constraints that might limit the overall mobility of the user (such as when they are standing or sitting without the use of a table) to hold the food and fully use their arms and/or hands. Again by way of non-limiting example, such foods could include items such as: salads with dressings and/or other toppings; the types of ingredients that often come mixed and served in wraps or bowls; or similarly comprised combinations of bite sized ingredients mixed with seasonings, condiments, and/or sauces.

Container body 110 is preferably formed of a material having a wall thickness and a balance of flexibility and rigidity such that the sides of container body 110 can be squeezed by a hand applying pressure above or below the position of lift 150 in order to control and move lift 150 in the desired direction, and optionally to cause lift 150 to stay at a desired location within container body 110, yet maintain its shape in holding contents and in standing alone, without collapsing, on for example a flat surface such as a table, a cup holder, or the like. By way of non-limiting example, container body 110 may be made of materials such as cardboard, foils, polymers, silicones, combinations of the foregoing, or any other type of material that is sufficiently flexible to allow the user to control the movement of the lift 150 by applying hand pressure to the outside of container body 110, yet is preferably rigid enough to hold its shape with the bottom of container body 110 sitting on a surface at rest.

Figure 3:
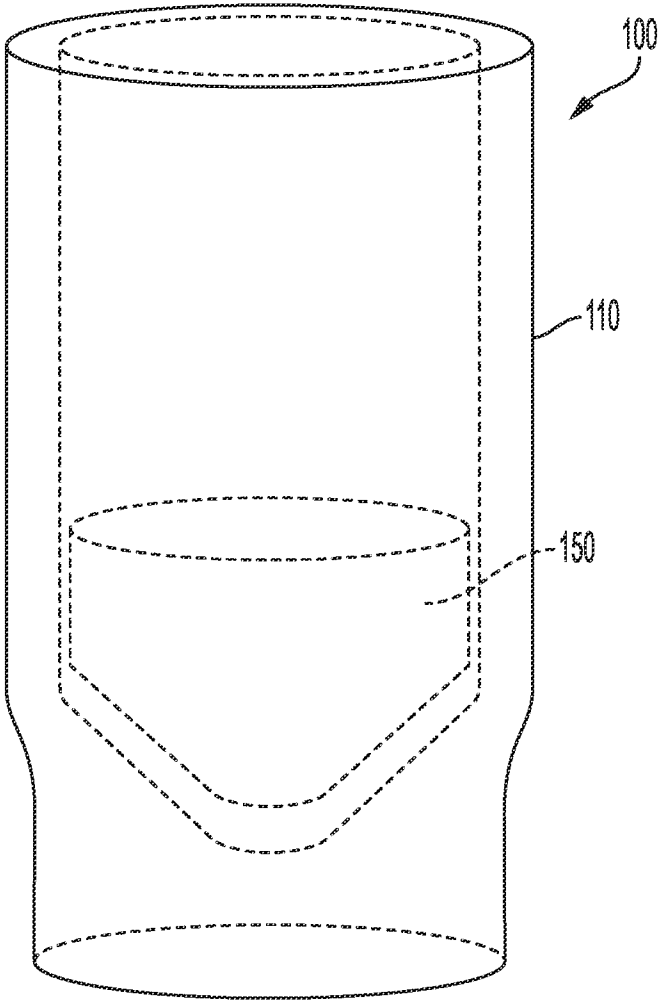
FIG. 3 is a side view of a food container and dispenser in accordance with further aspects of an embodiment of the invention.

In certain configurations, both the interior and exterior surfaces of container body 110 may take the shape of a hollow cylinder that may have, for example, a circular base capable of standing container body 110 upright. However, alternative cross-sectional shapes, such as octagon, oval, rectangular, etc., and possibly varying cross-sectional shapes along the length of container body 110, may be used without departing from the scope of the invention in order to meet a particular user's functional or aesthetic purposes. Further depending on the application and material, the external shape of container body 110 may match the internal shape of container body 110, or alternatively the external shape may include contours designed to assist the user in the controlled movement of the lift 150 and/or to meet other ergonomic or aesthetic purposes. By way of non-limiting example, and with reference to FIG. 3, the exterior of container body 110 may include a narrowing of the external dimension of the sleeve just below the height level where the tapering section of the lift 150 begins when the lift 150 is at rest at the base of the container body 110, such that a hand holding the container body 110 at the base can easily begin the process of raising lift 150 inside of container body 110.

Likewise, container body 110 may include a bottom wall forming a base of container body 100, or alternatively in certain configurations may have an open bottom. Preferably, in each configuration, the walls of container body 110 maintain sufficient rigidity to hold the overall upright shape of container body 110 when not supported by the user.

Container body 110 preferably has an overall length (from top to bottom) that optimally enables easy operation by an adult with one hand; however, depending on the use case, it may also be practical to operate using two hands. Further, while it is imagined that the pressing pressure applied to the container body 110 to move lift 150 will be achieved by the use of a user's hands, it is also conceivable that such movement of lift 150 may be achieved by a non-human mechanical force, device, or source of pressure.

Figure 4A:
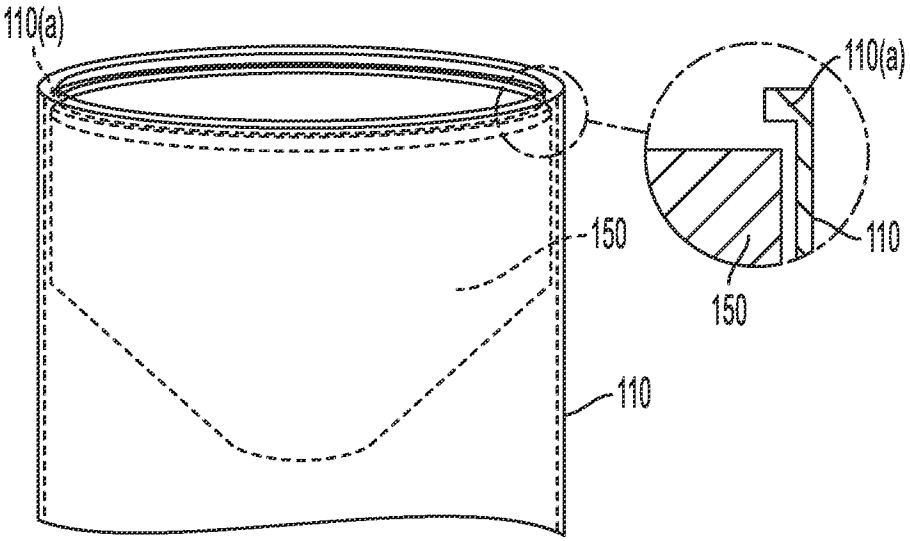
FIGS. 4A and 4B are close-up views of the top portion of a food container and dispenser in accordance with further aspects of an embodiment of the invention.
Figure 4B:
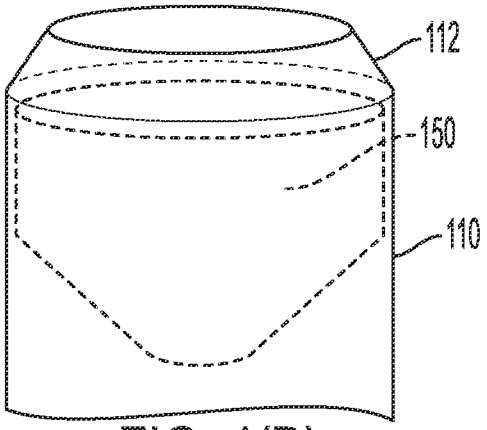
Figure 5:
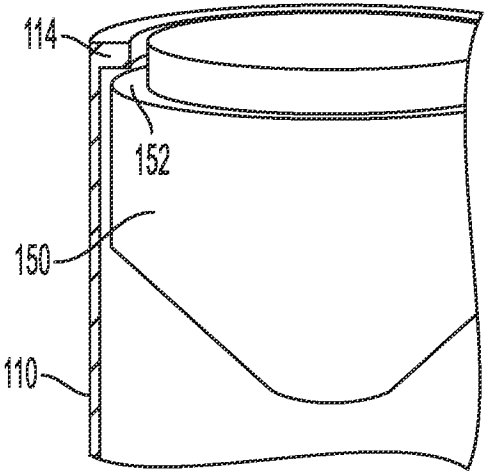
FIG. 5 is a close-up, partial sectional view of the top portion of a food container and dispenser in accordance with still further aspects of an embodiment of the invention.

Next, and as shown in FIG. 4A, the top end of container body 110 may have a configuration that prevents lift 150 from "popping" out through the top end of container body 110 during use, particularly by making the width of the top, open end of container body 110 narrower than the widest portion of lift 150. More particularly, the top end of container body 110 may have a rim 110(*a*) that extends inward from the outer, vertical wall of container body 110 at the open end of container body 110, which rim defines an opening having a smaller perimeter than the widest perimeter of lift 150. As a further option, the top end of container body 110 may have a narrowing wall section 112, as shown in FIG. 4B, which narrowing wall section 112 defines an opening having a smaller perimeter than the widest perimeter of lift 150. Still further, and as shown in FIG. 5, the top end of container body 110 may include a lip 114 that extends inward from the outer wall of container body 110, and lift 150 may include a stop wall 152 at its upper end sized to engage the bottom of lip 114, thus allowing the top-most surface of lift 150 to reach the very top of container body 110 while still preventing its inadvertent movement past the top-most edge of container body 110. In certain configurations, container body 110, and particularly the open, top end of container body 110, has sufficient flexibility that it will stretch upon application of manual force (e.g., in a radial direction) to allow removal of lift 150 from inside of container body 110, but will maintain its shape with a smaller perimeter than that of lift 150 absent the application of such an intentional, disfiguring force. Thus, the open end of container body 110 will allow relatively easy removal of lift 150 from the system 100 when desired (e.g., for cleaning and subsequent reuse), but will hinder inadvertent exit of lift 150 from container body 110 without such intentionally applied force.

Figure 6B:
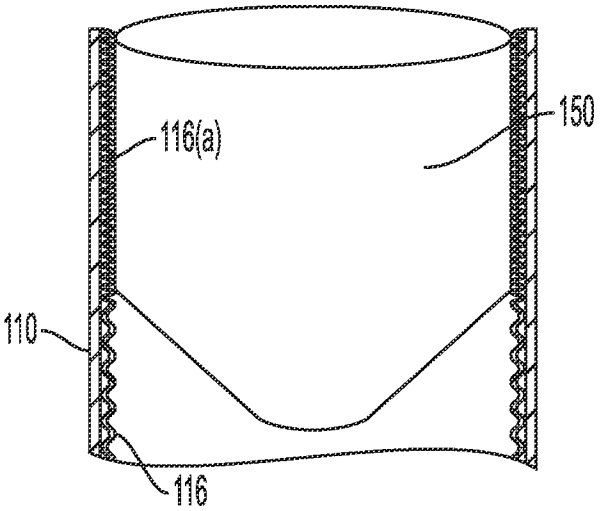
FIGS. 6A and 6B are a close-up, sectional views of a food container and dispenser in accordance with further aspects of an embodiment of the invention.
Figure 6A:
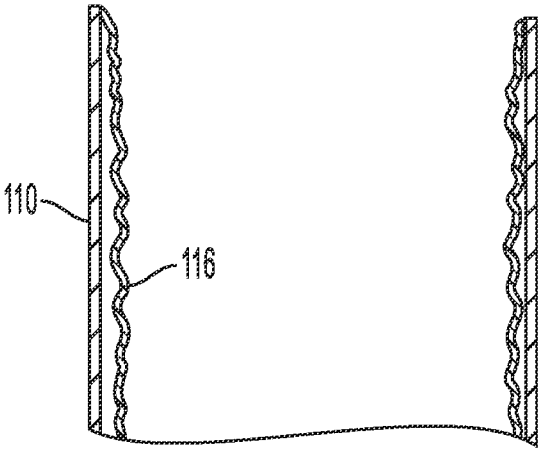

Optionally, and in accordance with certain features of an embodiment, the walls of container body 110 may be comprised of multiple layers that may be laminated or similarly joined to one another, or alternatively may be attached to one another only at limited locations such that portions of one or more layers hang free from an adjacent layer. For example, and as shown in FIGS. 6A and 6B, the interior of container body 110 may include an interior layer 116 closest to lift 150 that may be held to the interior of container body 110 such as at the top-most portion of the interior wall of container body 110, but in at least some other portions is not attached to the next outer layer of container body 110. Thus, at least portions of interior layer 116 may move with respect to the interior of container body 110. As a result, as lift 150 moves within container body 110, inner layer 116 may tend to regionally bunch (as shown at 116(*a*) in FIG. 6B) wherein it aligns with the upper portion of lift 150, in turn lightly binding lift 150. Such binding force is easily overcome by the user intentionally applying force to the outside of container body 110, but upon removal of such force, the binding resulting from loose portions of inner layer 116 will aid in keeping lift 150 at the position at which it was left when the user stopped applying an external force.

In certain configurations, such inner layer 116 may also be joined to the next outer layer of container body 110 at, for example, the bottom of the inner layer 116, and optionally at still other locations throughout the length of inner layer 116, such that inner layer 116 may be permanently joined to the interior of container body 110.

Figure 7B:
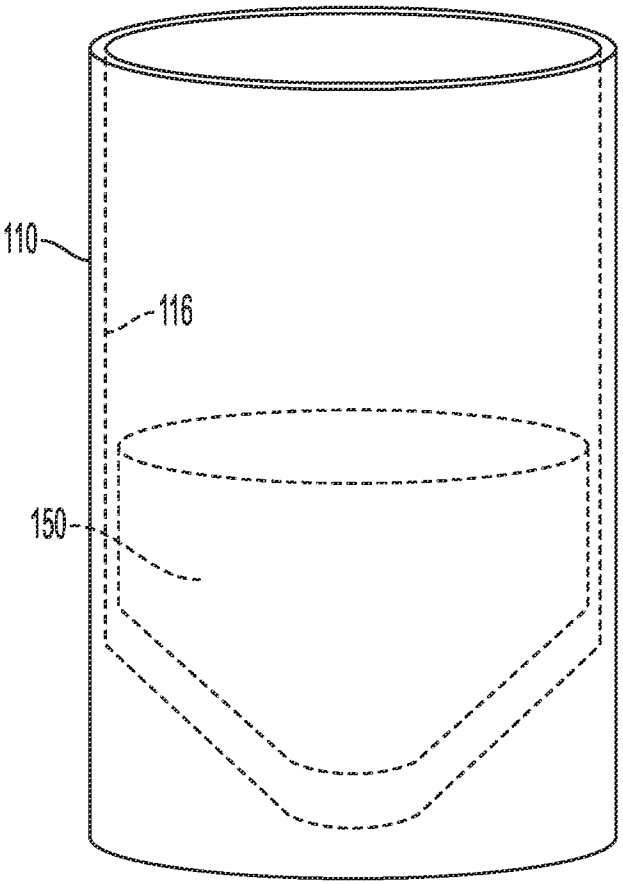
FIGS. 7A and 7B are side views of a food container and dispenser in accordance with further aspects of an embodiment of the invention.
Figure 7A:
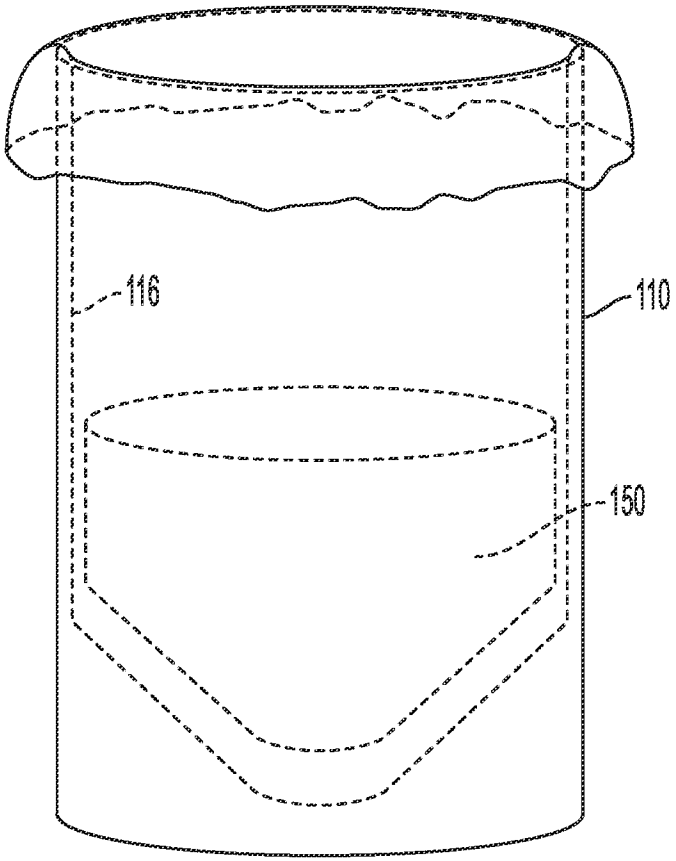
Figure 8:
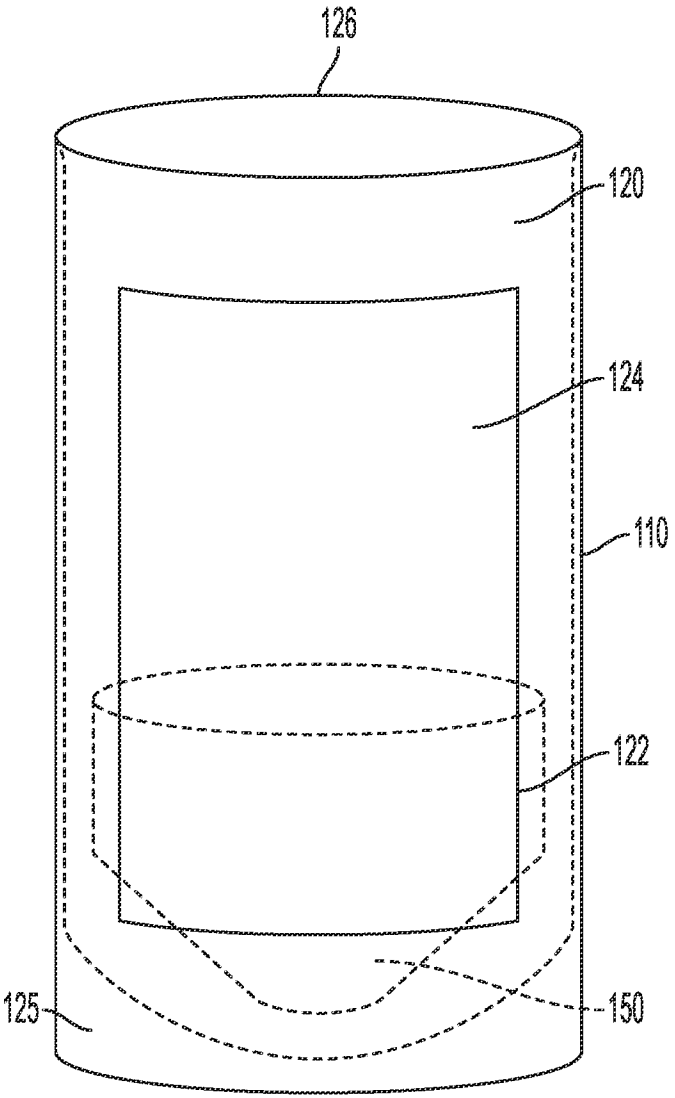
FIG. 8 is a side view of a food container and dispenser in accordance with still further aspects of an embodiment of the invention.

In certain configurations, such inner layer 116 may comprise a disposable "baggie" liner or flexible wall cartridge that is inserted inside the container body 110, as shown in FIGS. 7A, 7B, and 8. In certain configurations, once the baggie or cartridge is inserted, the lift 150 may then be loaded inside of the liner or flexible wall cartridge and pressed down to the bottom of the interior of the container body 110, followed by loading the food on top of the lift 150 and inside the baggie. Alternatively, the baggie or cartridge may be provided preloaded with the lift 150, with or without food product. For example, a flexible wall cartridge may be provided in a sealed configuration with the lift at the bottom interior of the cartridge, and food product between the lift and the top of the cartridge. When the user desires to consume the food product, they may then place the cartridge inside of container body 110, tear off or otherwise open the top of the cartridge, and use the lift to push food inside of the cartridge towards the dispensing outlet at the top of the container body 110.

In still other configurations, a sealed cartridge filled with food may be placed inside of container body 110 with lift 150 already placed in container body 110, such that it remains outside of and below the cartridge during use. Likewise in still further configurations, lift 150 may be of unitary construction with the flexible wall cartridge such that the lift and flexible wall cartridge together form a single, unitary piece. In such configurations, the lift may comprise a thickened or hardened region of the flexible was cartridge at its bottom, providing sufficient rigidity or resistance against collapsing or deforming so that it may be squeezed and thus moved toward the outlet of the food container and dispenser.

In still further configurations, the internal liner or flexible wall cartridge may itself comprise an edible structure. For example, a user may form a leaf of lettuce, a sheet of edible rice paper, or such other edible product that may be manually shaped into a wrapper and serve as the flexible internal layer as described above.

Optionally, the bottom of the baggie or cartridge may be removably attached to the container body 110, such as by way of non-limiting example use of a glue dot on the bottom exterior of the baggy or cartridge, or via complementary sections of hook-and-loop fastening material on the bottom or lower sides of the exterior of the baggy and the adjacent sections of the interior of the container body 110, mechanical twist-type locking mechanisms, or such other temporary fixation devices as may occur to those skilled in the art. As explained above, in some configurations the baggy liner or cartridge wall may tend to displace with respect to the interior wall of container body 110, which may result in localized binding of the baggie or cartridge wall material against lift 150 which will supplement the holding force between the interior of container body 110 and lift 150, such that lift 150 remains stable and in place during both movement and in the resting position. In addition, the baggy or cartridge may be fitted by combination of custom sizing to match the shape of the top, open end of container body 110 (as shown in FIG. 7A) and/or through use of a connecting attachment applied to the top, open end of container body 110 (as shown in FIG. 7B), and such that the top of the bag or cartridge remains reliably in place during rest or movement of the lift 150 in either direction.

With respect to further features of an embodiment, and with reference to FIG. 8, container body 110 may include an outer layer 120 and inner layer 124, where inner layer 124 has a different flexibility than outer layer 120.

For example, in an exemplary configuration, outer layer 120 may be formed of a material having more rigidity than inner layer 124, such as semi-rigid cardboard or heavy paper stock, while inner layer 124 may be formed of a material having more flexibility, such as a baggie material, foil, or other highly flexible material, having an interior dimension with close tolerance to the outer-most perimeter of lift 150. In this configuration, outer layer 120 may optionally include openings 122 in both a front face 125 and a back face 126 of outer layer 120, which openings allow direct contact with inner layer 124 for enabling a user to easily squeeze container body 110 to move lift 150 as desired. In this configuration, inner layer 124 may optionally form an interior pouch (optionally including a pre-packaged meal already positioned inside of inner layer 124, with or without lift 150) that may be slipped into outer layer 120 and removed after use, such that outer layer 120 may provide a reusable carrier for food dispensing system 100.

Alternatively, inner layer 124 may extend only over openings 122 in front face 125 and back face 126, and thus be permanently affixed to an interior of outer layer 120 (in, for example, a food dispensing system 100 that is entirely configured as a disposable item).

Still further, and with respect to further exemplary configurations, outer layer 120 may be formed of a more flexible material and inner layer 124 may be formed of more rigid material, whereby a user may press inward on the inner layer 124 through openings 122 to engage and move lift 150.

Figure 9:
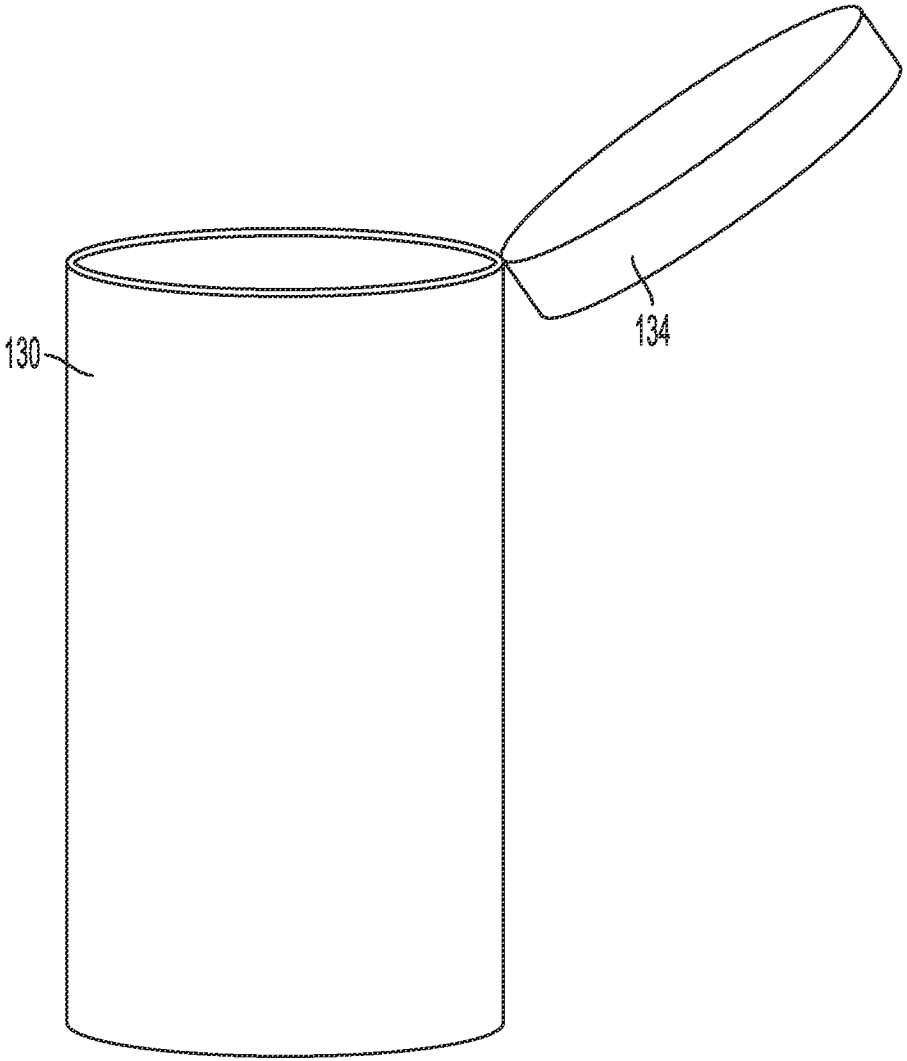
FIG. 9 is a side view of an insulting layer of a food container and dispenser in accordance with further aspects of an embodiment of the invention.

In a further exemplary configuration, a receptacle 130 having thermally insulating material 132 on an interior or exterior of such receptacle 130 may be provided, as shown in FIG. 9, that removably houses container body 110. Receptacle 130 may include a thermally insulated lid 134 that may close the open top of receptacle 130. For example, lid 134 may be equipped with a zipper or similarly configured closure device that engages a complementary element on the body of receptacle 130. Likewise, in certain configurations, one or more layers of container body 110 may comprise a thermally insulating material. More particularly, at least one of inner layer 116 and/or container body 110 may be formed of a thermally insulating material, or together may form a thermally insulting layer between them, so as to provide thermal insulation to the food product inside of container body 110.

Figure 10:
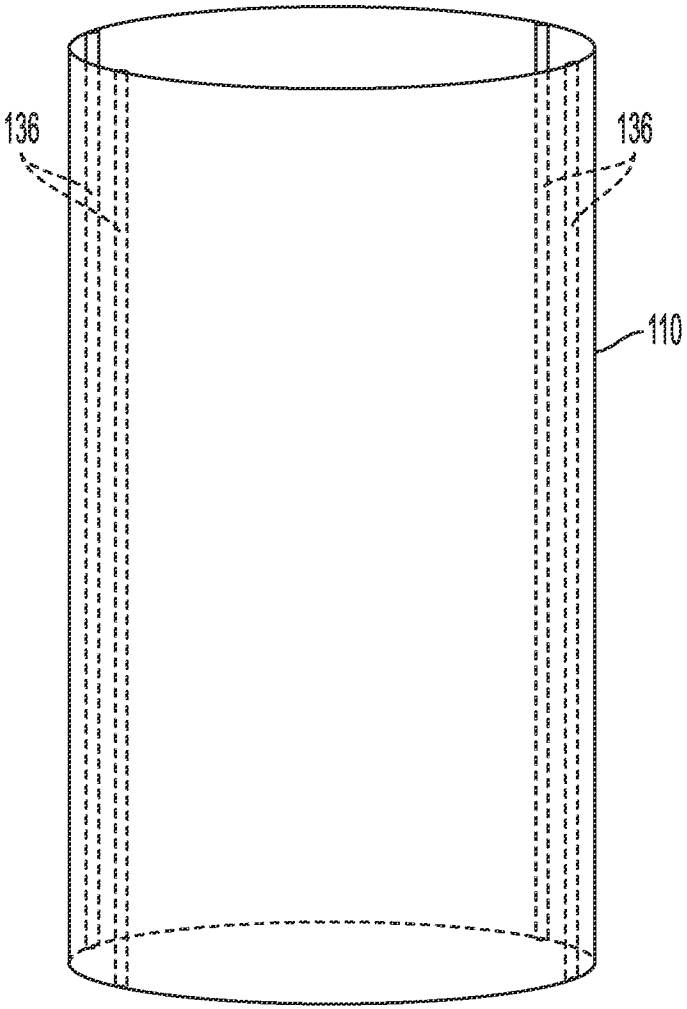
FIG. 10 is a side view of a food container and dispenser having vertical elements in accordance with further aspects of an embodiment of the invention.

In certain embodiments, it may be desirable to provide strengthening along the walls of container body 110 to ensure that it is able to maintain its vertical shape when not being manipulated by a user. To that end, and as shown in FIG. 10, vertical elements 136 having greater rigidity than container body 110 may be embedded within the walls of container body 110, particularly at the side ends of container body 110 that are orthogonal to the sides that the user will squeeze in order to move lift 150. Such vertical elements 136 may, by way of non-limiting example, be formed of thin sections of wood, plastic, or such other preferably inexpensive materials as may occur to those skilled in the art, and that will add sufficient rigidity to container body 110 to ensure that it will maintain its upright shape when standing unsupported by a user's hand.

Figure 11:
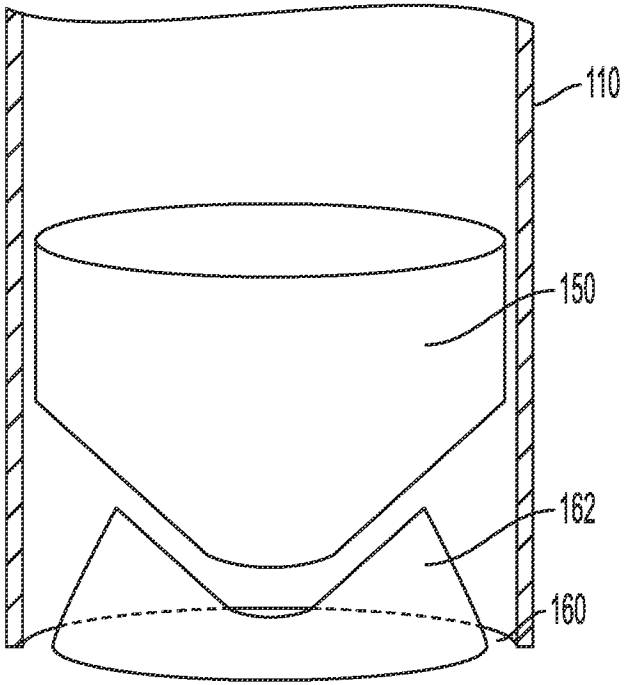
FIG. 11 is a side view of a bottom portion of a food container and dispenser in accordance with further aspects of an embodiment of the invention.

As mentioned above, container body 110 also may optionally have a base that is configured to aid in allowing food dispensing system 100 to stand upright when unsupported. For example, a bottom surface 111 (FIG. 1) of container body 110 may be of unitary construction with the vertical walls of container body 110, particularly where the entirety of container body 110 is of sufficient rigidity so as to maintain its upright shape when unsupported by a user. By way of non-limiting example, container body 110 may be formed of cardboard, and the bottom surface of container body 110 may comprise folded sections of cardboard that extend downward from the side walls of container body 110, such that container body 110 may be folded flat when not in use (e.g., for purposes of shipping multiple units of system 100 in a flat, stacked package prior to use). Alternatively, a separate base 160 may be provided as shown in FIG. 11, having a bottom plate that matches in shape the perimeter of container body 110. In such a configuration, the bottom plate of base 160 may optionally be formed of a material having greater rigidity than the vertical walls of container body 110, such as thermoplastic or other such preferably inexpensive, rigid, light-weight materials as may occur to those skilled in the art. By affixing the bottom edge of the sidewalls of container body 110 to the bottom plate of base 160, the walls of container body 110 will maintain their intended shape despite having sufficient flexibility to allow a user to easily squeeze them to move lift 150.

Optionally, base 160 may also include a nesting mount 162 having a notch configured to receive the bottom, tapered portion of lift 150. Nesting mount 162 may serve to optimally position lift 150 inside of container body 110 so as to allow the user to readily grasp and initiate movement of lift 150 inside of container body 110.

Further, base 160 may preferably have an outer perimeter that is sized for fitting within, for example, a standard cup holder. A bottom edge of the walls of container body 110 may thus be joined to the perimeter edge of base 160 (as shown in FIG. 11), or optionally to the top, planar face of base 160 at a location inward from the outer perimeter edge of base 160.

Figure 12:
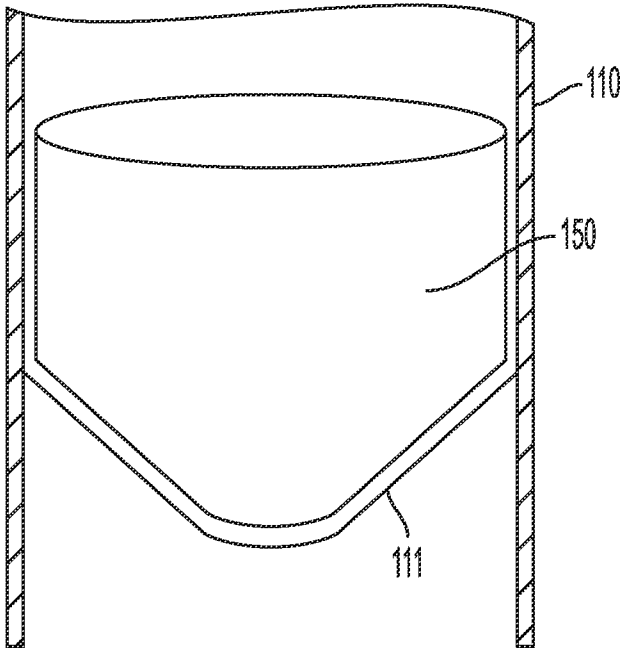
FIG. 12 is a side view of a bottom portion of a food container and dispenser in accordance with still further aspects of an embodiment of the invention.

Alternatively, in those configurations in which the bottom surface of container body 110 is formed unitarily with the vertical walls of container body 110, the interior, top face of that bottom surface may itself include a tapered bottom 111 as shown in FIG. 12 to mirror the bottom external shape of the lift 150. Further, in those configurations in which the bottom surface of container body 110 is formed unitarily with the vertical walls of container body 110, that bottom surface may preferably have an outer perimeter that is sized for fitting within, for example, a standard cup holder.

In other exemplary configurations, container body 110 may be open at its bottom, and thus allow for insertion and removal of lift 150 optionally through such open bottom.

Figure 13:
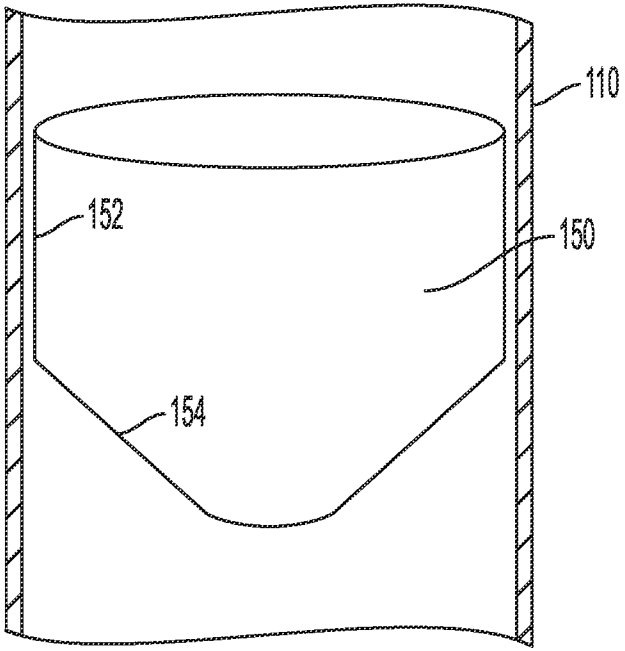
FIG. 13 is a side view of a lift inside of a food container and dispenser in accordance with certain aspects of an embodiment of the invention.

Next, and with reference to FIG. 13, lift 150 is preferably made of a solid material with very smooth (antifriction) surfaces. In an exemplary embodiment, the top portion of lift 150 may form a generally vertical collar 152 that may be, for example, 1-3 cm high, which collar 152 allows the lift 150 to slide uniformly within the interior of container body 110 without tilting over in the process. The bottom of lift 150, beginning at the bottom of the collar 152, is preferably tapered (as shown at 154) to enable the user to gradually "push" the lift 150 upward in container body 110, in a controlled way, by squeezing the sides of the exterior of container body 110 below the collar 152, with their hand. As the container body 110 may come in a variety of shapes and sizes, the actual total height of the collar 152 and bottom, tapered portion 154 of the lift 150 necessary to limit tilting will be, in part, a function of the amount of the lift 150 that will be touching the inner wall of container body 110 as it glides, and that measurement's proportion to the internal horizontal diameter dimension of the interior wall of the container body 110. In certain configurations, lift 150 may exclude collar 152 such that the tapered bottom 154 of lift 150 extends from the top to the bottom of the lift 150. Further, the diameter of the collar 152 of the lift 150 may be of a dimension substantially matching the diameter of the internal cavity of the container body 110, meaning preferably within a 1 cm tolerance between the external wall of the lift 150 and the internal wall of the container body 110 (although such tolerance could be more in the case where there also exists a detachable container sleeve wall liner, as discussed above).

Figure 14C:
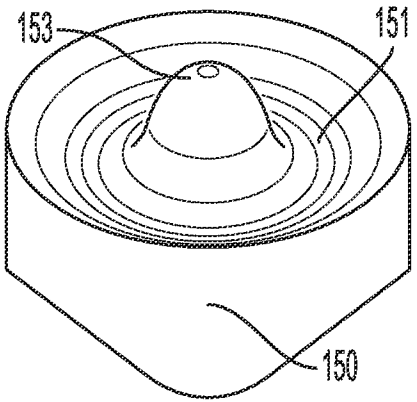
FIGS. 14A-14C are side views of a lift for use with a food container and dispenser in accordance with further aspects of an embodiment of the invention.
Figure 15C:
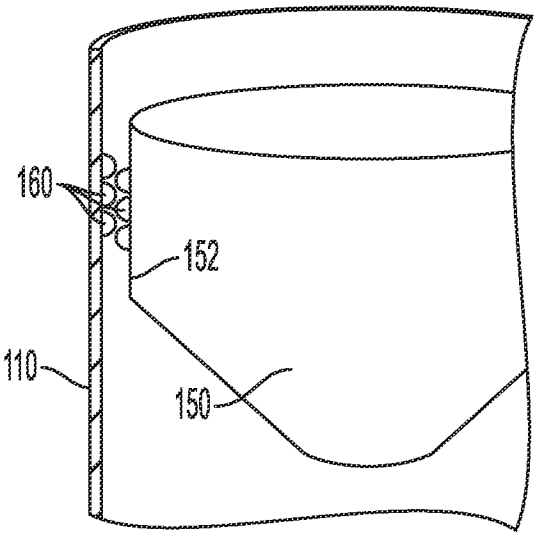
FIGS. 15A-15C are side views of a lift inside of a food container and dispenser in accordance with still further aspects of an embodiment of the invention.
Figure 14B:
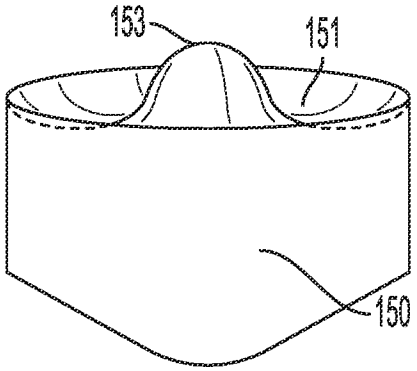
Figure 15B:
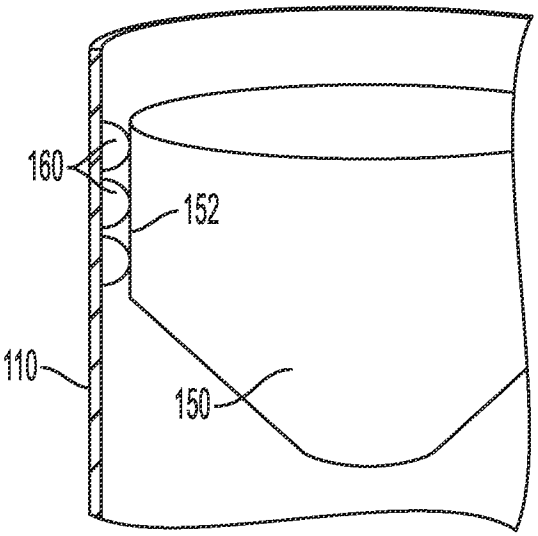
Figure 14A:
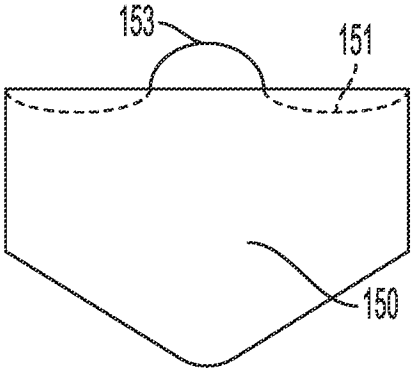
Figure 15A:
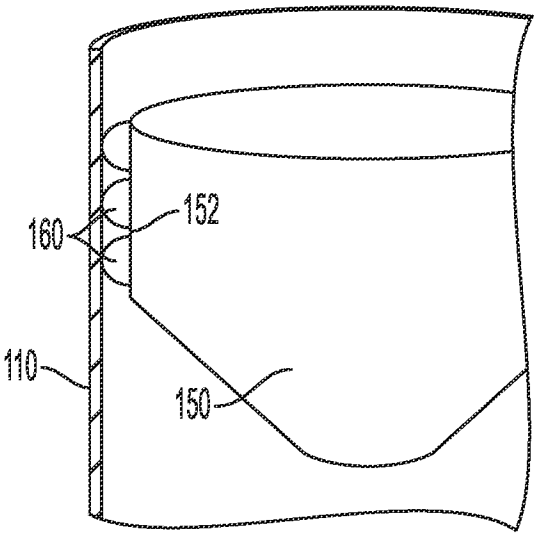

The top surface of lift 150 may be flat, or may possess a concave shape such that food tends to center as it rests on the platform or is elevated toward the open top face of the container body 110. Alternatively, the top surface of lift 150 may optionally include a "moat" having a conically shaped raised portion 153 in the middle, surrounded by a trough-like ringed depression 151, and then bounded on the outside by the rim of the collar of lift 150, as shown in FIGS. 14A through 14C. In addition, and as shown in FIGS. 15A through 15C, lift 150 may also have a variety of lift gripping members 160, which lift gripping members 160 may comprise, by way of non-limiting example, bumps, bubbles, bristles, rings, gaskets, or similarly configured protrusions coming out of the sides of the collared section 152 of lift 150 (as shown in FIG. 15A) to create additional stopper action to assist in controlling the elevation both in movement and at rest within the container body 110. Likewise, collar 152 of lift 150 may be smooth as discussed above, and the interior wall of container body 110 may be provided similarly configured lift gripping members 160 (as shown in FIG. 15B) extending into the interior of container body 110 to provide such additional stopper action against lift 150. Even further, both collar 152 of lift 150 and the interior wall of container body 110 may be provided similarly configured lift gripping members 160 (as shown in FIG. 15C) to provide such additional stopper action.

Figure 16C:
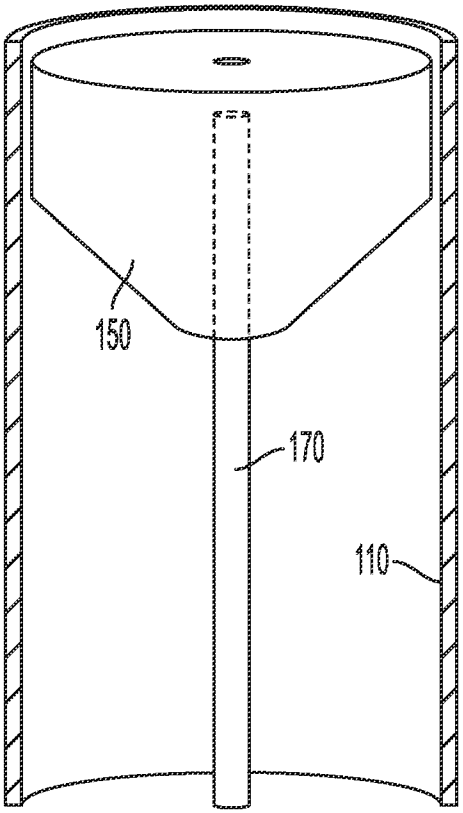
FIGS. 16A-16C are side views of a food container and dispenser including a lift guide rail in accordance with certain aspects of an embodiment of the invention.
Figure 16B:
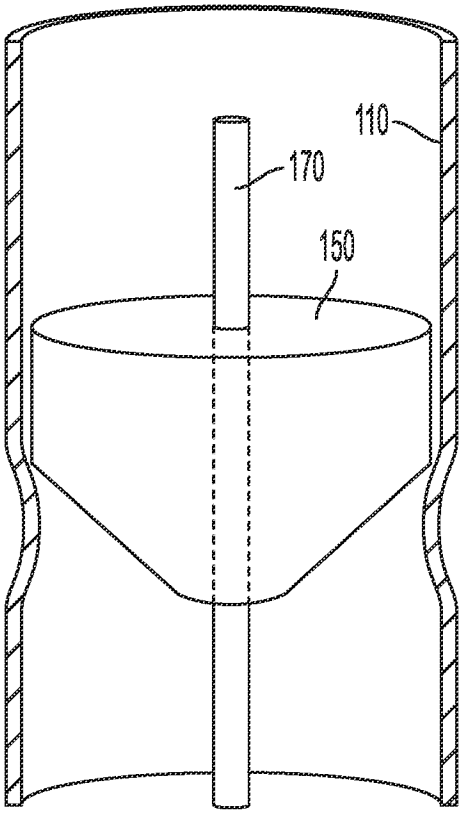
Figure 16A:
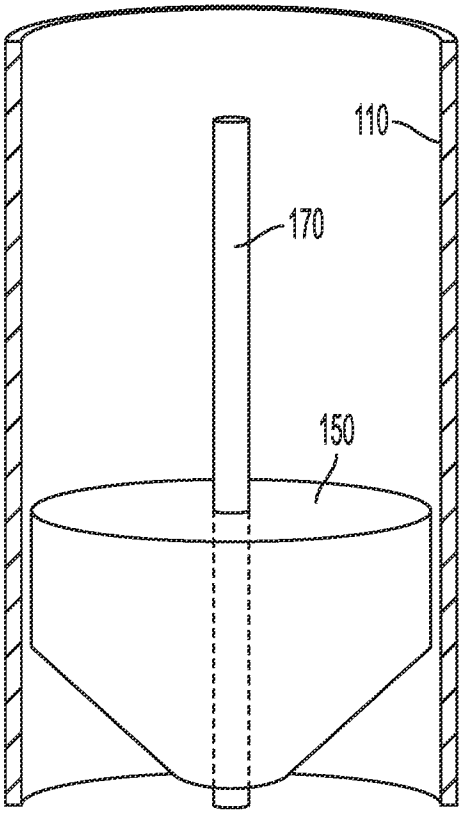

In other configurations and as shown in FIGS. 16A-16C, a guide rail (or rails) 170 can be provided in support of movement of lift 150 (either internal or external to lift 150). In an exemplary embodiment, guide rail 170 may comprise a central rod secured to a base or to the center of the base of container body 110 with a correspondingly shaped hole extending through the center of lift 150, such that when lift 150 is placed into container body 110 with the rod 170 threaded through it, lift 150 is then guided by rod 170 when moving in either direction. Optimally and with continued reference to FIGS. 16A-16C, the length of such rod 170 is such that a portion remains in the body of lift 150 when the top of lift 150 approaches the top, open mouth of container body 110, but is likewise short enough such that the top of rod 170 remains well below the lip of container body 110, and therefore won't touch a user's mouth during eating.

Figure 18A:
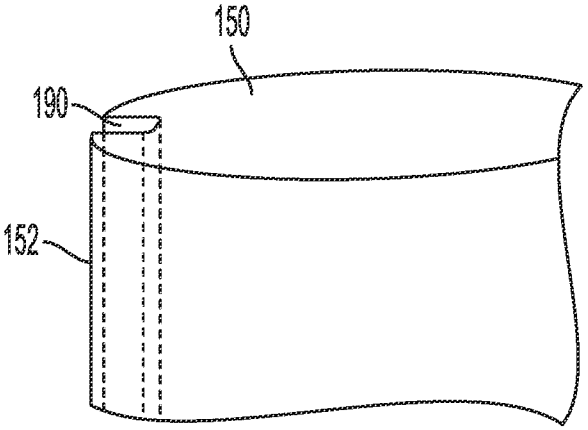
FIGS. 18A-18B are a partial side and a top view, respectively, of a lift for use with the food container and dispenser of FIG. 17.
Figure 18B:
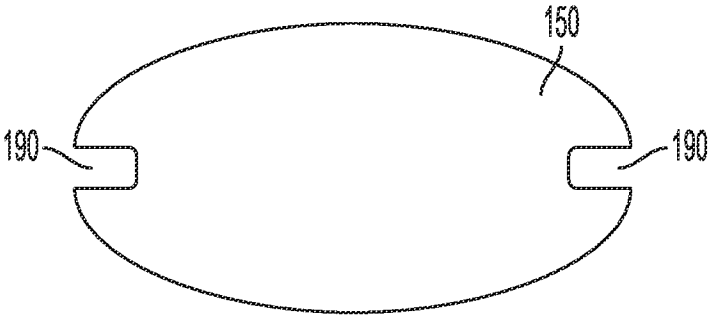
Figure 17:
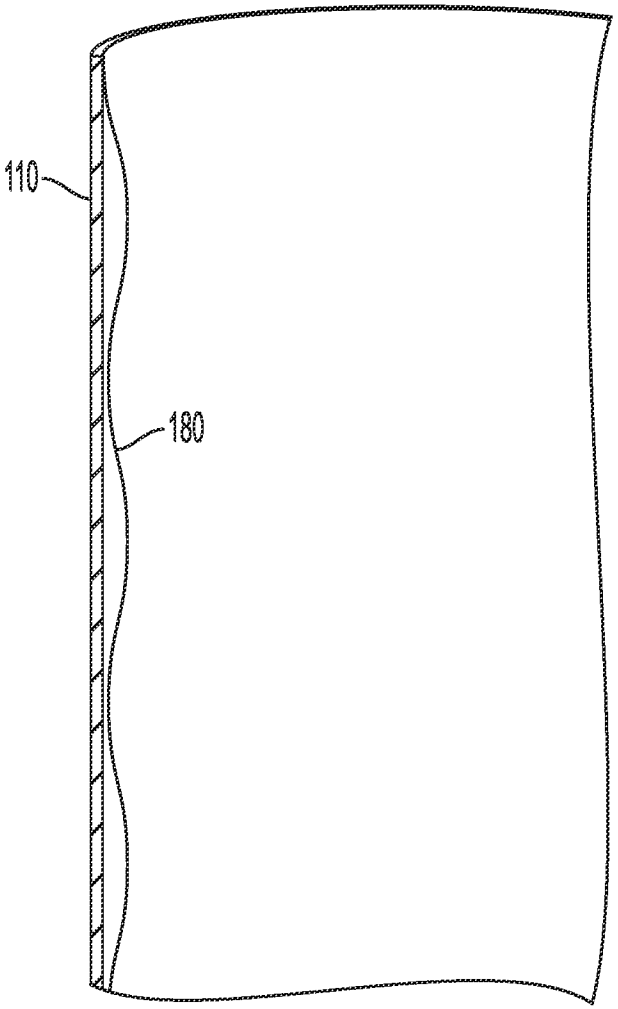
FIG. 17 is a partial side view of a food container and dispenser including a lift guide rail in accordance with further aspects of an embodiment of the invention.

In other configurations, and with reference to FIG. 17, lift gripping members 160 as discussed above may particularly comprise vertical rails 180 that extend along the interior vertical walls of container body 110, and that vary in width along their length. As shown in FIGS. 18A and 18B, in such configuration, lift 150 may be provided notches 190 in each sidewall of collar portion 152, which notches 190 are sized to receive vertical rails 180 therein. Optionally, notches 190 may themselves have a contour that is complementary to the varying-width contour of vertical rails 180, e.g., a surface that provides a negative contour to the contour of vertical rails 180. The raised portions of vertical rails 180 are sized to minimally push against notches 190 in lift 150, thus providing both a guide for lift 150 as it travels through container body 110, and a holding force that gently squeezes the sides of lift 150 so as to hold it in place when the user stops applying squeezing pressure to the outside of container body 110. As container body 110 is generally sufficiently flexible to allow the user to squeeze the same to move lift 150, the force necessary to overcome the squeezing force applied by vertical rails 180 against the sides of lift 150 is low and thus will not prevent the user from easily raising or lowering lift 150 inside of container body 110, but will still provide sufficient holding force when the user's squeezing force is removed to keep lift 150 at its current location inside of container body 110.

In certain other configurations, lift 150 may be provided with rail 180 on its outer edge, and notches 190 may extend along the interior vertical walls of container body 110, so that lift 150 is again guided by rails 180 and notches 190 as above.

Lift 150 is preferably made of a material of sufficient rigidity such that it will move upon pressing the outside of container body 110, while retaining its shape, maintaining its dimension in conforming with the internal diameter of container body 110, and otherwise possessing sufficient protection from breaking down due to "pushing" pressure or becoming saturated by moisture as to impair such movement and/or otherwise become unstable as a food platform. By way of non-limiting example, lift 150 may be formed of rigid plastic, paper, cardboard (e.g., a collapsible cardboard section that may be shipped flat and thereafter folded into the shape of lift 150), and such other materials as will be apparent to those skilled in the art. Optionally, in certain configurations, the lift 150 may be made edible or out of food (such as a crouton, for example) or even of a hollow rigid shell that is filled with something edible. Still further, lift 150 may itself define a hollow chamber, which in certain configurations may be covered with a manually removable cover, lid, film, or the like, such as (by way of non-limiting example) a removable plastic film, that keeps the contents of lift 150 separated from the food product above lift 150. When the lift is exposed to allow the user access to it, they may then peel off the plastic film lid of lift 150 to access its contents, which could comprise a desert item, a toy or novelty item, or such other items as may occur to those skilled in the art. In still further configurations, lift 150 may define a hollow chamber without a cover, such that the open, top face of the lift 150 is defined by a top edge extending around the perimeter of the top of lift 150. In such an optional configuration, food product within container 110 may extend to the bottom of the hollow interior of lift 150, while lift 150 still functions as described above to direct food toward the open, top mouth of the container upon compression of the flexible outer walls of container 110. In still further configurations, lift 150 need not include a continuous edge around its perimeter, and may instead comprise segmented wall portions that nonetheless define at least a tapered portion that may be squeezed to cause movement of the lift, as discussed above. By way of non-limiting example, a lift 150 configured in this manner may take the form of a wedge or "V" shape.

Further, in certain configurations, lift 150 may be perforated from its top surface through to the bottom of lift 150 in order to allow fluid from food product above lift 150 to drain into a portion of container body 110 below lift 150, thus preventing excess liquid from being pushed toward the user and potentially overflowing out of the top of container body 110.

A food dispensing system 100 configured in accordance with at least certain aspects of the invention is optimized for one-handed operation by a user. More particularly, the tapered portion of lift 150 may maximize the efficiency one gains when properly matching the form of lift 150 to the hand's natural movement in applying pressure to the exterior of container body 110. The optimal lift 150 with taper shape then serves to balance both the level of platform and wall dimension, in relation to the container, necessary to remain stable in its glide through the container body 110, while providing the shape efficiency for the hand to maximize control and pace of movement. As a result, these considerations make up a unique and differentiating contribution to various configurations of the device, offering a significant improvement and enhancement to functionality and use.

A portable food container and dispenser, according to various aspects of an embodiment, may be designed in differing versions to be considered applicable to either reusable or disposable use cases, respectively. Such use cases may also inform the choice of materials and additional features of the portable food container and dispenser.

Figure 20:
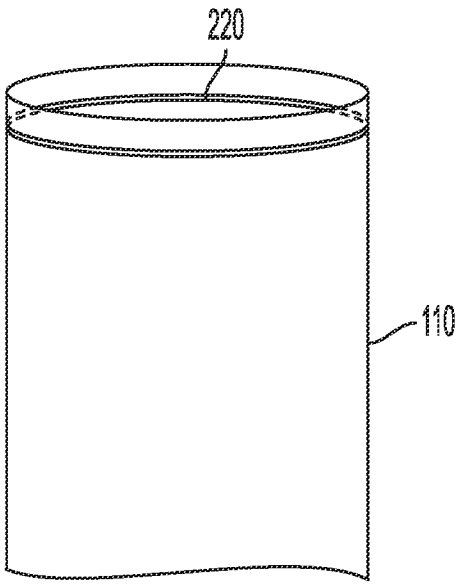
FIG. 20 is a side view of a food container and dispenser including a zip-lock closure in accordance with certain aspects of an embodiment of the invention.
Figure 19:
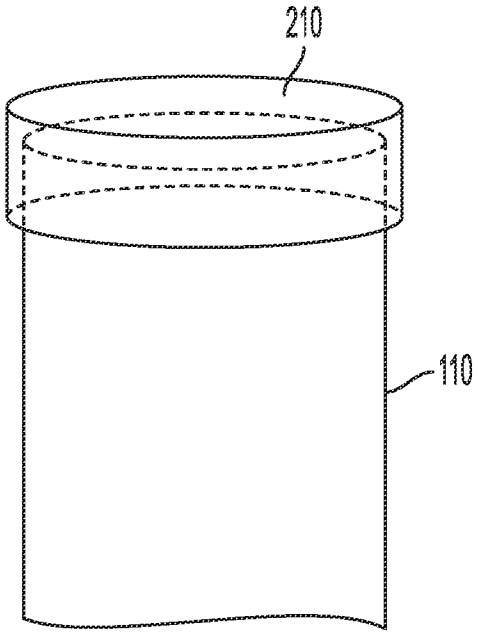
FIG. 19 is a side view of a food container and dispenser including a lid in accordance with certain aspects of an embodiment of the invention.

In some configurations, a sealed mouth enclosure may be provided that keeps food inside the container body 110 when not in use or during transport, as shown in FIGS. 19 and 20. In some embodiments, such enclosure can be either integrated into the container body 110 or affixed as a detachable accessory, and possesses either an attached or detachable cap/lid 210. Examples of such lids may include a threaded neck with a screw-on top or a simple, unthreaded, snap on cap (with or without a tether for the cap). Such lids 210 may be provided in a variety of versions, including but not limited to those where the base of the connection type (threaded or snap neck, for example) is either permanently integrated into the top, mouth section of the container body 110, or as an accessory top that can be removed for cleaning, for example. Another type may comprise a zip-lock style resealable enclosure 220 as shown in FIG. 20.

Figure 21:
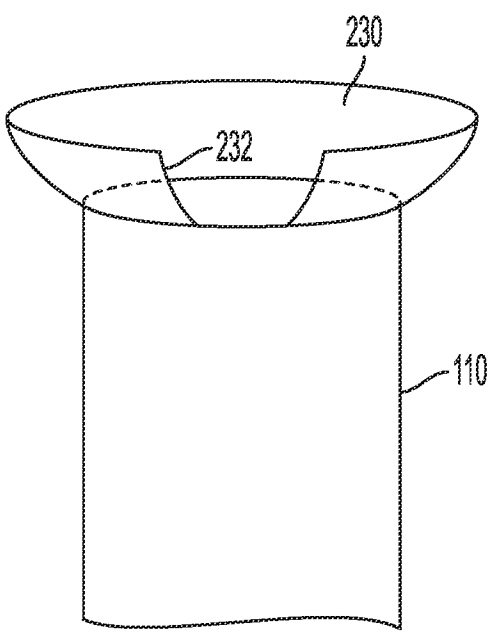
FIG. 21 is a side view of a food container and dispenser including a spill guard or gutter in accordance with further aspects of an embodiment of the invention.

Further, in some configurations and as shown in FIG. 21, a spill guard and/or gutter 230 may be provided, forming a mouth enclosure collar with a wide gutter to keep food bits from spilling out of the mouth of the unit. Such a guard and/or gutter may include an indentation 232 in one portion to allow easy user mouth access to the lip of the container. Further, such a guard and/or gutter may be integrally formed with container body 110, or alternatively may comprise a separate, removable element that may be placed at the top of container body 110 during use.

Figure 22:
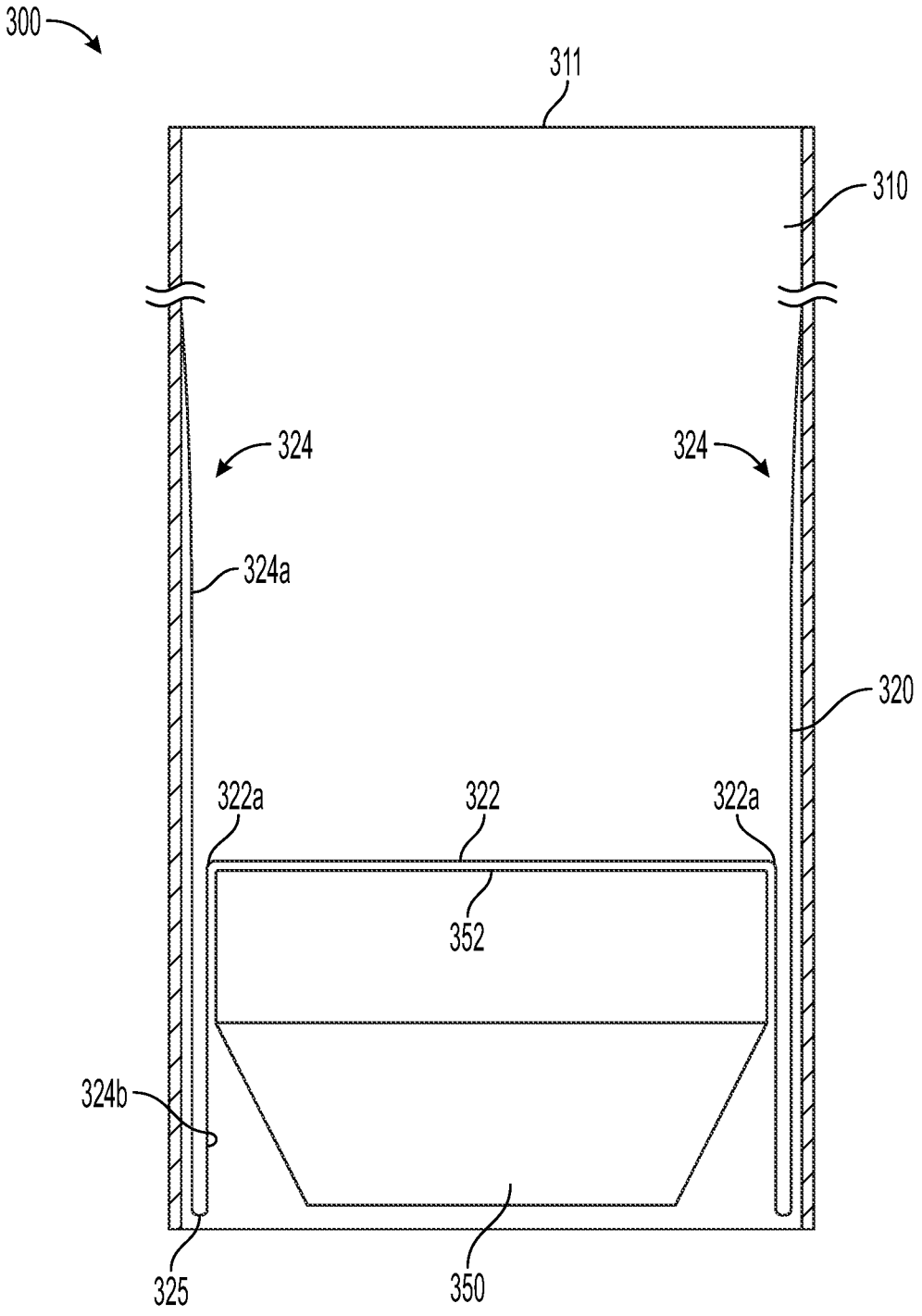
FIG. 22 is a side partial cross-sectional view of a food container and dispenser according to certain aspects of an embodiment of the invention.

Next, with reference to FIG. 22, a food container and dispenser 300 is shown in accordance with certain aspects of an embodiment of the invention. Food container and dispenser 300 again includes a flexible container body 310 and a lift 350 having a top surface 352 that faces a dispensing outlet 311 defined by the open, upper end of container body 310, and a bottom, tapered surface that allows a user to squeeze flexible container body 310 at a location adjacent the tapered surface of the lift to push the lift in the direction of dispensing outlet 311. As noted above, lift 350 need not have a continuous outer wall or a continuous top surface, but may be broken or segment along its outer-most edge, and in some configurations may even be provided in the form of a "V"-shaped wedge. Further, an invertible insert 320 is positioned on the interior of container body 310 and may be permanently affixed or removably attached to the interior wall of container body 310, such as at a location in the mid-region of container body 310. Invertible insert 320 may likewise be attached to the interior of container body 310 at a location closer to dispensing outlet 311. Invertible insert 320 may attach to the interior of container body 310 at a single location along the length of container body 310 (e.g., at one or more points along a circumferential line extending around the circumference of the interior walls of container body 310), or along a wider attachment region (e.g., at one or more vertical seams or other linear points of attachment around the circumference of the interior walls of container body 310), and may be joined to the interior of container body 310 at least at two locations along the circumference of container body 310. Further, in certain configurations, the interior of container body 310 may provide multiple points of attachment for the invertible insert 320 so that invertible insert 320 may attach at varied positions along the length of container body 310, or for attachment to another inverted layer or incorporated structure.

In further configurations, invertible insert 320 may be positioned inside of container body 310 without attachment to container body 310. In such configurations, invertible insert 320 may optionally include a portion that overlaps the dispensing outlet 311 of container body 310 to form, for example, a cuff extending around the dispensing outlet 311. Such a cuff may then be temporarily attached to container body 310, such as by way of a fastener joining the cuff to a portion of container body 310, or via a clip or rim placed temporarily over the cuff and the dispensing outlet 311, or such other fastener as may occur to those skilled in the art. Still further, in certain exemplary configurations invertible insert 320 may have a mechanical fastener on its outer surface that engages a mechanical fastener on the interior or exterior side of container body 310, such as by way of a twist-lock, a snap attachment, a hook-and-loop connection, or such other attachment devices as will occur to those skilled in the art, in each case allowing for the temporary joining and ultimate separation and removal of invertible insert 320 from container body 310.

As shown in FIG. 22, container body 310 need not have a bottom wall, but may optionally have a bottom wall formed integrally with the rest of container body 310, or may receive a removable closure (such as by way of example a threaded cap or similarly configured end closure).

A bottom-most portion 322 of invertible insert 320 is sized to overlap top surface 352 of lift 350. Further, invertible insert 320 has sidewalls 324 that include a first portion 324(*a*) that extends parallel to and immediately adjacent to an the interior surface of container body 310, and a second portion 324(*b*) that extends parallel to first portion 324(*a*) from a fold 325 at the bottom end of first portion 324(*a*). Fold 325 is intended to refer to the bottom-most extent of first portion 324(*a*) and second portion 324(*b*) of sidewalls 324, the location of which will change as lift 350 is moved upward toward dispensing outlet 311, and as invertible insert 320 is likewise inverted into itself. Second portion 324(*b*) and bottom-most portion 322 of invertible insert 320 thus form a lift receiver in which lift 350 is positioned during use.

In use, as a user squeezes flexible container body 310 to move lift 350 towards dispensing outlet 311, top surface 352 of lift 350 pushes against bottom-most portion 322 of invertible insert 320, likewise pushing bottom-most portion 322 of invertible insert 320 toward dispensing outlet 311. Such movement of bottom-most portion 322 of invertible insert 320 toward dispensing outlet 311 carries second portion 324(*b*) of invertible insert 320 upward, lengthening that second portion 324(*b*) and shortening first portion 324(*a*) as it travels toward dispensing outlet 311. Such configuration may offer a number of advantages over the configurations shown in FIGS. 1-21 above. Namely, lift 350 does not make direct contact with food contents of invertible insert 320, keeping it clean from food debris and allowing lift 350 to be readily re-used. Likewise, as the food contents of invertible insert 320 are kept out of contact with lift 350, they may remain sealed inside of a closed package formed by invertible insert 320, which may be opened at the top for use when desired.

In that regard, a food package comprised only of invertible insert 320 and its food contents may, in certain configurations, be distributed to consumers separately from container body 310, allowing a wide variety of pre-packaged food items (including frozen and microwavable food items) to be used with a single container body 310 and lift 350. In certain configurations, a food package comprised of invertible insert 320 and its food contents may optionally be packaged and distributed with lift 350 either separated from or joined to the bottom of invertible insert 320, within the lift receiver formed by bottom-most portion 322 and second portion 324(*b*) of invertible insert 320, or even with lift 350 formed unitarily with invertible insert 320 as discussed above. Invertible insert 320 may then be placed inside of container body 310 (which may comprise, for example, a cardboard or similarly configured and at least partially compressible sleeve) and used in that form, or may be placed with such a container body together into a compressible external container body 110 (as in FIG. 1) and used in that form.

Further, in those cases in which invertible insert 320 is placed within a container body 310, as the lift 350 remains in contact with the exterior of invertible insert 320 as it travels toward dispensing outlet 311 (as opposed to lift 350 being in direct contact with the interior surface of container body 310), ease of movement of lift 350 may be maintained without concern of excess friction between lift 350 and the interior of container body 310 causing binding and jerked or non-smooth movement between their respective surfaces.

As mentioned above, invertible insert 320 may be removably attachable to container body 310. By way of non-limiting example, the exterior of invertible insert 320 may be provided a mechanical fastener (e.g., a button, snap, a section of hook-and-loop fastening material, a twist-lock connector, etc.) on an outer surface of invertible insert 320 that engages a complementary mechanical fastener positioned on an interior or exterior (if invertible insert 320 is cuffed over the outlet 311 of container body 310) wall of container body 310. Likewise, the exterior of invertible insert 320 may be provided an adhesive fastener (e.g., a peel, stick and press section of adhesive) that allows for the optionally temporary joinder of invertible insert 320 to the interior or exterior wall of container body 310, which adhesive may in certain configurations be overcome by deliberate removal by the user after the food product inside of invertible insert 320 has been consumed. Still other devices for removably fastening the exterior of invertible insert 320 to the interior or exterior of container body 310 may likewise be used as will be apparent to those of ordinary skill in the art. In still further configurations, invertible insert 320 may be sized with respect to the interior walls of container body 310 so as to provide a friction fit between them, thus avoiding the need for a separate fastener and providing easy insertion and removal of insert 320 into and from container body 310.

In certain configurations, it may be preferable to size invertible insert 320 so that when it is joined to the interior of container body 310, bottom-most portion 322 of invertible insert 320 will not extend past dispensing outlet 311 when invertible insert 320 has been fully inverted (i.e., when lift 350 has been moved toward dispensing outlet as far as invertible insert 320 will allow). Likewise, invertible insert 320 is sized so that when it is in such fully inverted position, bottom-most portion 322 of invertible insert is preferably within at least one inch of dispensing outlet 311 so as to ensure sufficient access to undispensed food to allow its easy removal from invertible insert 320 without requiring tipping of container body 310 (although less than one inch is preferred). In still other configurations, invertible insert 320 may be sized to allow the entirety of insert 320 (other than that minimal portion joined to container body 310) to be inverted out of container body 310 through dispensing outlet 311 to enable easy washing of the entire surface of invertible insert 320. Optionally, at least a portion of invertible insert 320 may be separable from or not permanently affixed to container body 310, thus allowing for removal of lift 350 for easy washing or replacement, for example.

While FIG. 22 shows invertible insert 320 positioned within and attached directly to container body 310, container body 310 may alternatively itself comprise a highly flexible bag or baggie formed of the same material as invertible insert 320, with the two components permanently attached to one another and forming a single unit, but may likewise be formed of paper, cardboard, coated wrappers, or other similarly configured compressible materials. In this configuration, such flexible container body 310 may again be insertable as a cartridge into a compressible external container body 110 (as shown and discussed above with respect to FIGS. 1 and 2), and otherwise used as discussed above. Likewise in this configuration, such flexible container body 310 may be joined to the interior of compressible external container body 110 via mechanical or adhesive fasteners as discussed above (e.g., on the sides or bottom of flexible container body 310), or alternatively may be held in place simply via friction. Further, in this configuration, invertible insert 320 or flexible container body 310 may optionally be provided with a closure over the top of the container body (such as a cap or tearable and removable top portion of invertible insert 320 or flexible container body 310) that may be removed when food inside of invertible insert 320 is to be consumed.

Moreover, in each of the foregoing configurations, lift 350 may optionally be removably affixable to bottom-most portion 322 inside of the lift receiver of invertible insert 320, such as by way of a mechanical or adhesive fastener, to ensure that alignment is maintained between top surface 352 of lift 350 and bottom-most portion 322 of invertible insert 320 as they travel together toward dispensing outlet 311.

Optionally, in order to further aid in maintaining alignment between lift 350 and bottom-most portion 322 of invertible insert 320, bottom-most portion 322 may optionally be formed with greater rigidity than the remainder of invertible insert 320. By way of non-limiting example, while walls 324 of invertible insert 320 may be formed of highly-flexible material (of similar flexibility to, for example, a plastic bag or baggie, or other highly flexible materials such as paper-based, plant-based or the like), bottom-most portion 322 may be formed of a more rigid material, such as food-grade plastic or other higher rigidity material, that is of sufficient rigidity to maintain its shape, particularly when pressed by lift 350. Such region of higher rigidity may include both a planar section of bottom-most portion 322 that sits directly over the top surface 352 of lift 350, and downwardly extending corners 322(*a*) that wrap around the perimeter of lift 350. Such configuration ensures that bottom-most portion 322 of invertible insert 320 will properly seat against the top surface 352 of lift 350 when invertible insert 320 is initially positioned within container body 310 (or within compressible external container body 110).

Figure 23:
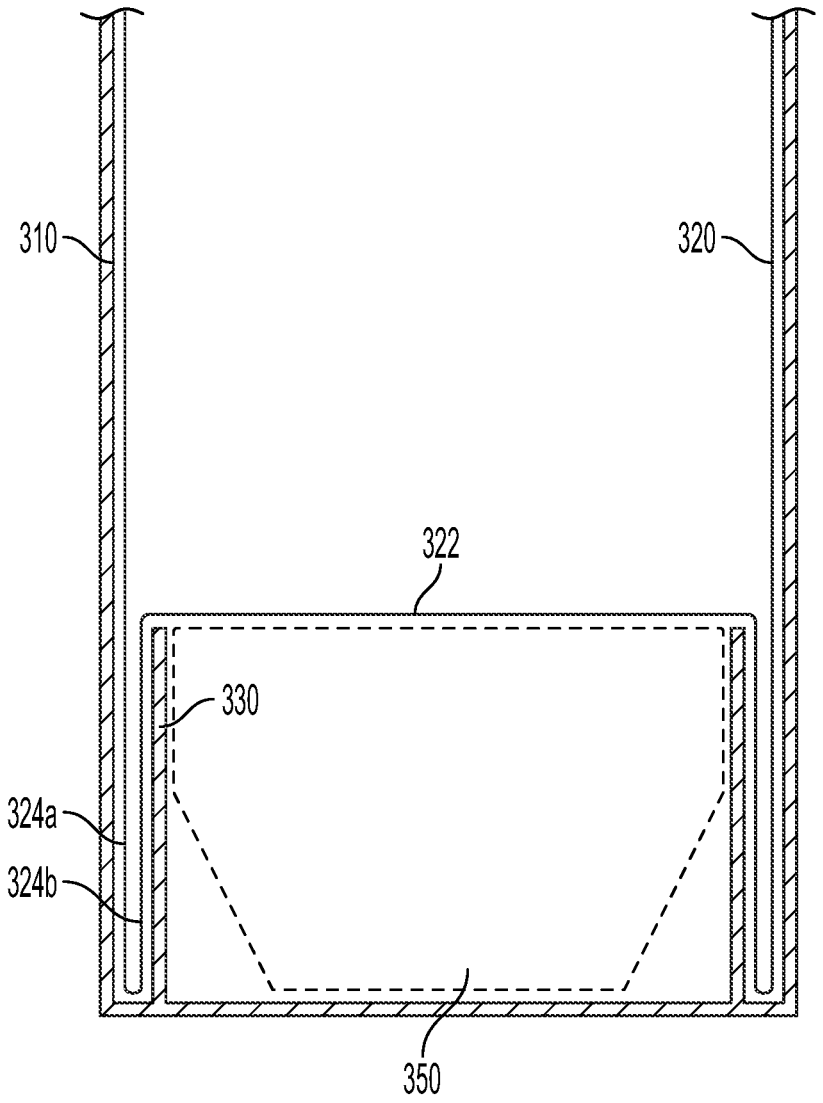
FIG. 23 is a side partial cross-sectional view of a food container and dispenser according to further aspects of an embodiment of the invention.

Alternatively or additionally, and with reference to FIG. 23, a lift receiver 330 may be provided, for example, at the bottom of container body 310, with lift receiver 330 sized to removably receive and properly position lift 350 before insertion of invertible insert 320. Lift receiver 330 may comprise a continuous or partial and segmented upstanding wall extending upward from the bottom of container body 310, the upward wall forming an open interior having an outer perimeter that conforms to, but is slightly larger than, the outer perimeter of lift 350. Lift receiver 330 may thus serve to both position lift 350 in the intended location so as to engage bottom-most portion 322 of invertible insert 320, and to ensure that bottom-most portion 322 of invertible insert 320 is properly seated at the intended location at the bottom of container body 310 (i.e., with second portion 324(*b*) of walls 324 of invertible insert 320 being positioned between lift receiver 330 and the interior wall of container body 310). In certain configurations, lift 350 may be inserted into lift receiver 330 by placing it through dispensing outlet 311 of container body 310 before placement of invertible insert 320.

In still further configurations, lift receiver 330 may be provided as a separate element, such as a partial or fully enclosed ring that may be positioned within and optionally affixed to the lift receiver or the folds in the bottom of flexible insert 320, with lift 350 first being positioned in the lift receiver 330, and thereafter flexible insert 320, lift receiver 330, and lift 350 inserted together into container body 310.

In certain configurations, for example where container body 310 and invertible insert 320 are provided as a single, preformed unit (e.g., for insertion into compressible external container body 110), lift 350 may be insertable into lift receiver 330 from a bottom of container body 320. Thus, in certain configurations container body 310 may have an open bottom end that is similarly configured to dispensing outlet 311. In such an open-bottom configuration, a user may (by way of non-limiting example) place invertible insert 320 into container body 310 so that an outlet end of invertible insert 320 is adjacent to outlet 311 of container body 310, and may place lift 350 into container body 310 below invertible insert 320 when ready to use. Optionally, a removable or openable lid may be provided to close the open bottom of container body 310 after lift 350 has been positioned in the bottom of container body 310.

Those skilled in the art will recognize that variations to the foregoing may be made without departing from the spirit and scope of the invention. For example, to maximize the reusability of the system, each of container body 310, invertible insert 320, and lift 350 may be removable and/or separable components. In other configurations, invertible insert 320 may be permanently fixed to container body 310, while lift 350 may remain removable (such as by providing container body 310 with an open bottom that may optionally be closed with a removable closure). In still other configurations, lift 320 may be permanently positioned within container body 310 below invertible insert 320 (such as where the entire food dispensing system is intended for single-use applications and disposal after such single use). Further, while invertible insert 320 is discussed above as being attached at an upper portion of container body 310, it may in certain configurations be joined to container body 310 at a position near or at the bottom of container body 310, with material forming invertible insert 320 bunched together next to lift 350 before dispensing begins, and with the invertible insert 320 expanding upward as lift 350 is directed upward toward dispensing outlet 311.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A hand-held food dispenser, comprising:

a first container having one or more manually compressible walls;

a lift inside of said first container and engaging an interior of said first container such that manual compression on an outside of said first container causes a portion of the interior of the first container to engage at least a portion of said lift to cause said lift to move along a length of said first container;

a flexible, invertible layer inside of said first container having a first portion in contact with said lift, and a second portion extending upward from said lift toward a top end of said first container; and a second container having one or more manually compressible walls, wherein said first container is removably attached inside of said second container.

2. The hand-held food dispenser of claim 1, said lift further comprising at least a first tapered wall.

3. The hand-held food dispenser of claim 1, said hand-held food dispenser further comprising:

a food dispensing outlet at a top end of said one or more manually compressible walls of said first container;

wherein said lift is removable from said first container through at least one of said food dispensing outlet or a bottom of said first container.

4. The hand-held food dispenser of claim 1, wherein said lift is affixed to said flexible, invertible layer.

5. The hand-held food dispenser of claim 1, wherein said flexible, invertible layer is removably attached to said interior of said first container.

6. The hand-held food dispenser of claim 1, said first container further comprising an openable closure over a food dispensing outlet of said flexible, invertible layer.

7. The hand-held food dispenser of claim 6, wherein said openable closure further comprises a tearable, removable portion of at least one of said first container and said flexible, invertible layer.

8. The hand-held food dispenser of claim 1, further comprising a connector having mating portions on said first container and said second container configured for removable attachment of said first container to said second container.

9. A hand-held food dispenser, comprising:

a container having one or more manually compressible walls;

a lift inside of said container and engaging an interior of said container such that manual compression on an outside of said container causes a portion of the interior of the container to engage at least a portion of said lift to cause said lift to move along a length of said container; and a flexible, invertible layer inside of said container having a first portion in contact with said lift, a second portion extending upward from said lift toward a top end of said container, and a third portion connecting said first portion to said second portion, wherein said third portion is positioned between said lift and said one or more manually compressible walls.

10. The hand-held food dispenser of claim 9, said lift further comprising at least a first tapered wall.

11. The hand-held food dispenser of claim 9, said hand-held food dispenser further comprising:

a food dispensing outlet at a top end of said one or more manually compressible walls of said container;

wherein said lift is removable from said container through at least one of said food dispensing outlet or a bottom of said container.

12. The hand-held food dispenser of claim 9, wherein said lift is affixed to said flexible, invertible layer.

13. The hand-held food dispenser of claim 9, wherein said flexible, invertible layer is removably attached to said container.

14. The hand-held food dispenser of claim 9, said container further comprising an openable closure over a food dispensing outlet of said flexible, invertible layer.

15. The hand-held food dispenser of claim 14, wherein said openable closure further comprises a tearable, removable portion of at least one of said first container and said flexible, invertible layer.

16. The hand-held food dispenser of claim 9, further comprising:

a lift receiver at a bottom of said container positioned between said lift and said one or more manually compressible walls.

17. The hand-held food dispenser of claim 16, wherein said lift receiver further comprises a vertical wall surrounding at least a portion of an outer perimeter of said lift.

18. A hand-held food dispenser, comprising:

a flexible, invertible food package insert having side walls and a lift receiver at a bottom of the flexible, invertible food package insert, the lift receiver being defined by a first portion of said flexible, invertible food package insert positioned to engage a top edge of a lift positioned in the lift receiver and a folded portion of said flexible, invertible food package insert;

wherein said lift is positioned with respect to said lift receiver such that a top edge of the lift is in contact with said first portion of said flexible, invertible food package insert, and such that side portions of said lift are positioned adjacent said folded portion of said flexible, invertible food package insert.

19. The hand-held food dispenser of claim 18, further comprising:

a container having one or more manually compressible walls;

wherein said flexible, invertible food package layer insert is positioned within said container.

20. The hand-held food dispenser of claim 19, further comprising a connector having a first portion on said flexible, invertible food package layer insert and a second portion on said container.

21. The hand-held food dispenser of claim 18, further comprising a second lift receiver inside of said lift receiver and sized to receive said lift therein.

22. The hand-held food dispenser of claim 18, said lift further comprising at least a first tapered wall.

23. The hand-held food dispenser of claim 18, wherein said lift is affixed to said flexible, invertible food package insert.

* * * * *